US006148869A

United States Patent [19]

Quigley

[11] Patent Number: 6,148,869

[45] Date of Patent: Nov. 21, 2000

[54] DUAL LAYER PAPERMAKING FABRIC FORMED IN A BALANCED WEAVE

[75] Inventor: Scott Quigley, Townville, S.C.

[73] Assignee: Wangner Systems Corporation, Greenville, S.C.

[21] Appl. No.: 09/213,194

[22] Filed: Dec. 17, 1998

[51] Int. Cl.[7] ..... D03D 13/00; D21F 1/10

[52] U.S. Cl. ..... 139/383 A; 442/208

[58] Field of Search ..... 139/383 A; 442/208

[56] References Cited

U.S. PATENT DOCUMENTS

| | | | |
|---|---|---|---|
| 4,709,732 | 12/1987 | Kinnunen | 139/383 A |
| 4,739,803 | 4/1988 | Borel | 139/383 A |
| 5,025,839 | 6/1991 | Wright | 139/383 A |
| 5,052,448 | 10/1991 | Givin | 139/383 A |
| 5,054,525 | 10/1991 | Vohringer | 139/383 A |
| 5,067,526 | 11/1991 | Herring | 139/383 A |
| 5,487,414 | 1/1996 | Kuji et al. | 139/383 A |
| 5,713,397 | 2/1998 | Quibley | 139/383 A |

*Primary Examiner*—Andy Falik
*Attorney, Agent, or Firm*—Pitney, Hardin, Kipp & Szuch LLP

[57] ABSTRACT

A wear resistant dual layer papermaking fabric, of stable construction, having a fiber support surface and a machine contact surface. The fabric comprises first picks of weft yarn woven with warp yarns to form weft yarn floats of equal length arranged diagonally over the support surface in a twill pattern. Second picks of weft yarn are woven with the warp yarns to form weft yarns floats of equal length arranged diagonally across the contact surface in a twill pattern. The weave pattern provides that the warp yarns inter-engage with the first and second picks in a balanced weave pattern which maintains the floats parallel.

21 Claims, 6 Drawing Sheets

DUAL LAYER PAPERMAKING FABRIC FORMED IN A BALANCED WEAVE

BACKGROUND OF THE INVENTION

The present invention is directed to a dual layer papermaking fabric which provides even drainage throughout and in which both the paper support surface and the machine contact surface are weft dominant surfaces.

Normally, dual layer papermaking fabrics are woven with a single set of warp threads, upper layer weft threads and lower layer weft threads. Normally, the number of upper layer weft threads is twice that of the lower layer weft threads. It is also desirable to have long weft floats on the paper support surface to provide a smooth surface with adequate permeability. The machine contact surface also preferably comprises long weft floats for adequate permeability and for protecting the warp threads from wearing through contact with the machine rolls.

Papermaking fabrics developed with these features in mind are disclosed in U.S. Pat. Nos. 4,739,803; 4,709,732; 5,025,839; and 5,555,917.

The instant invention has for its object, a papermaking fabric having a paper support surface which is smooth so as to reduce fabric marking on the paper to a minimum.

Another object of the invention is a papermaking fabric having a stable paper support surface providing that the minimum of markings are uniform.

Another object of the invention is providing a papermaking fabric having a minimum of exposure for the warp threads on the outer fabric surfaces providing for increased wear and improved uniformity.

Another object of the invention is a papermaking fabric which maintains even drainage throughout.

Another object of the invention is a papermaking fabric having stabilized machine direction inner floats.

Another object of the invention is a papermaker's fabric having stabilized cross machine direction floats.

Another object of the invention is providing a papermaking fabric in which the warp cross-overs on the paper support surface and the warp cross-unders on the machine contact surface are arranged in diagonal rows across the fabric forming a balanced weave having a twill on each surface.

SUMMARY OF THE INVENTION

The instant invention is directed to a wear resistant dual layer papermaking fabric having an upper paper fiber support surface and a lower machine contact surface. The fiber support surface is formed of first picks of weft yarn weaving with a plurality of warp yarns in a twill weave to form a support surface having consecutive weft yarn floats of equal length passing over equal members of adjacent warp yarns. The lower machine contact surface is formed of second picks of weft yarn weaving with the warp yarns in a twill weave to form weft yarn floats of equal length passing under even numbers of the warp yarns. The number of the support surface weft yarn floats are twice the number of the machine surface weft yarn floats. The weave is balanced throughout the weave pattern.

The fabric is woven in an eight harness weave pattern. The weave pattern repeats every eight warp yarns and every forth-eight picks of weft yarn. The warp yarns are preferably of equal size while the weft yarns are preferably of a plurality of sizes.

The fabric is structured with half of the first picks of weft yarn located substantially vertically of the second picks of weft yarn and the remainder of first picks of weft yarn are located between half of first picks weft yarn. The papermaking fabric of the invention has a lower CMD layer having a selected number of yarns per inch and an upper CMD layer having a selected number of yarns per inch twice that of the lower CMD layer. A system of MD yarns are interwoven with the CMD yarn layers in a repeated weave pattern in which each of the MD yarn interweaves to cross under an even number of lower CMD yarns and over a number of CMD yarns twice the number of passed under lower CMD yarns per weave pattern repeat. The cross-unders and cross-overs are arranged in twill arrays diagonally across the weave pattern providing a balanced weave. The fabric comprises a machine surface and a support surface having a plurality of equal length CMD floats arranged in a twill pattern between the spaced MD cross-unders.

The weave pattern comprises eight warp yarns and forty-eight weft yarns per repeat. The CMD yarns are arranged at a density of between 5 to 200 yarns per inch with the upper layer density being about twice that of the lower layer. The MD yarns are arranged at a density above that of the upper and lower layers. This arrangement provides a porosity of between 400–900 CFM.

Each MD yarn weaves to cross over and under an equal number of upper layer CMD yarns per repeat of the weave pattern. The number of cross-overs is four. The weave pattern provides that the upper and lower layer CMD yarns form equal length floats over the support surface and over the machine contact surface.

DESCRIPTION OF A PREFERRED EMBODIMENT

Figure 1:
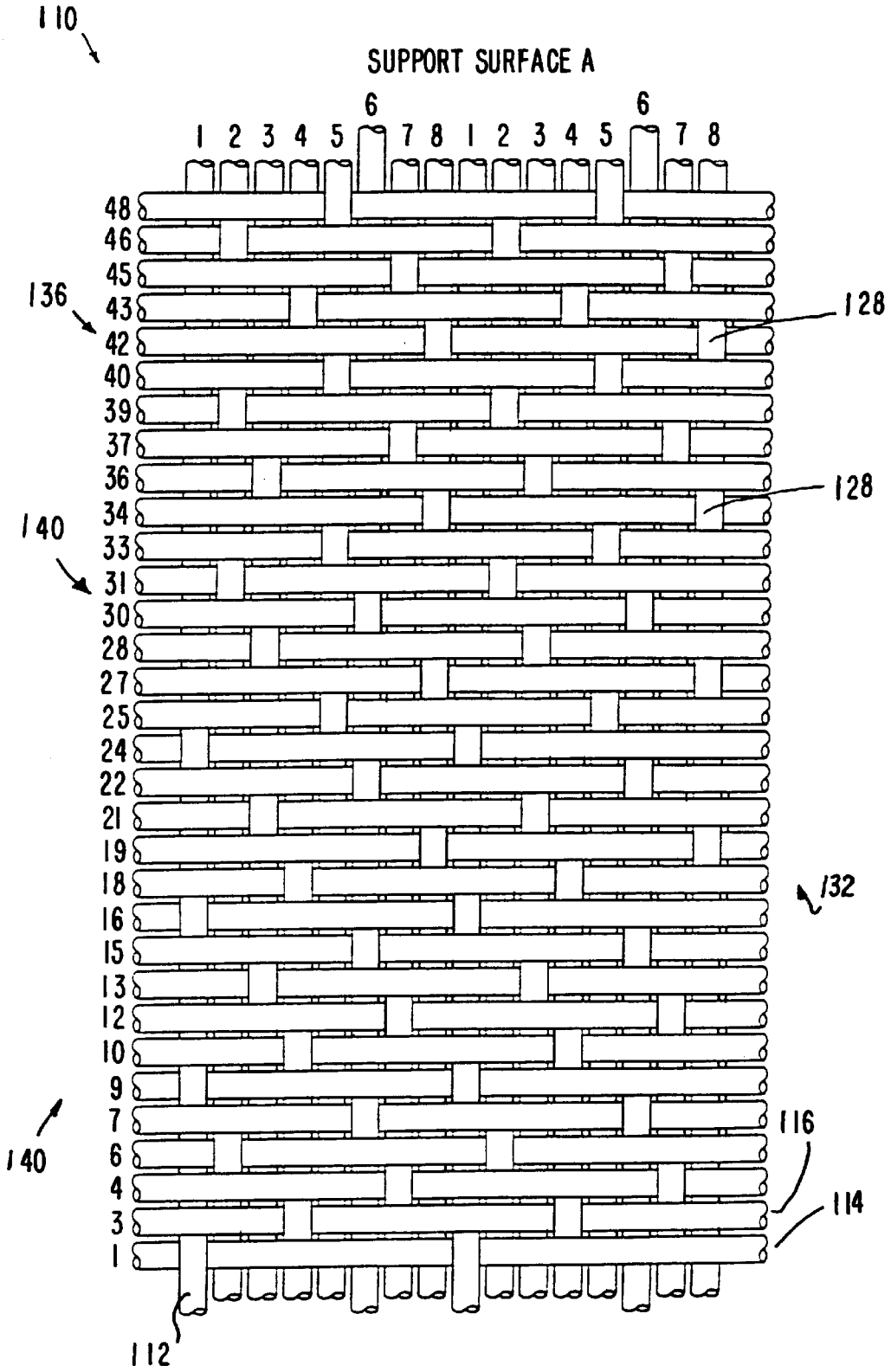
FIG. 1 is a sectional top view of the paper support surface of the papermaking fabric of the invention through two repeats of the weave pattern.
Figure 2:
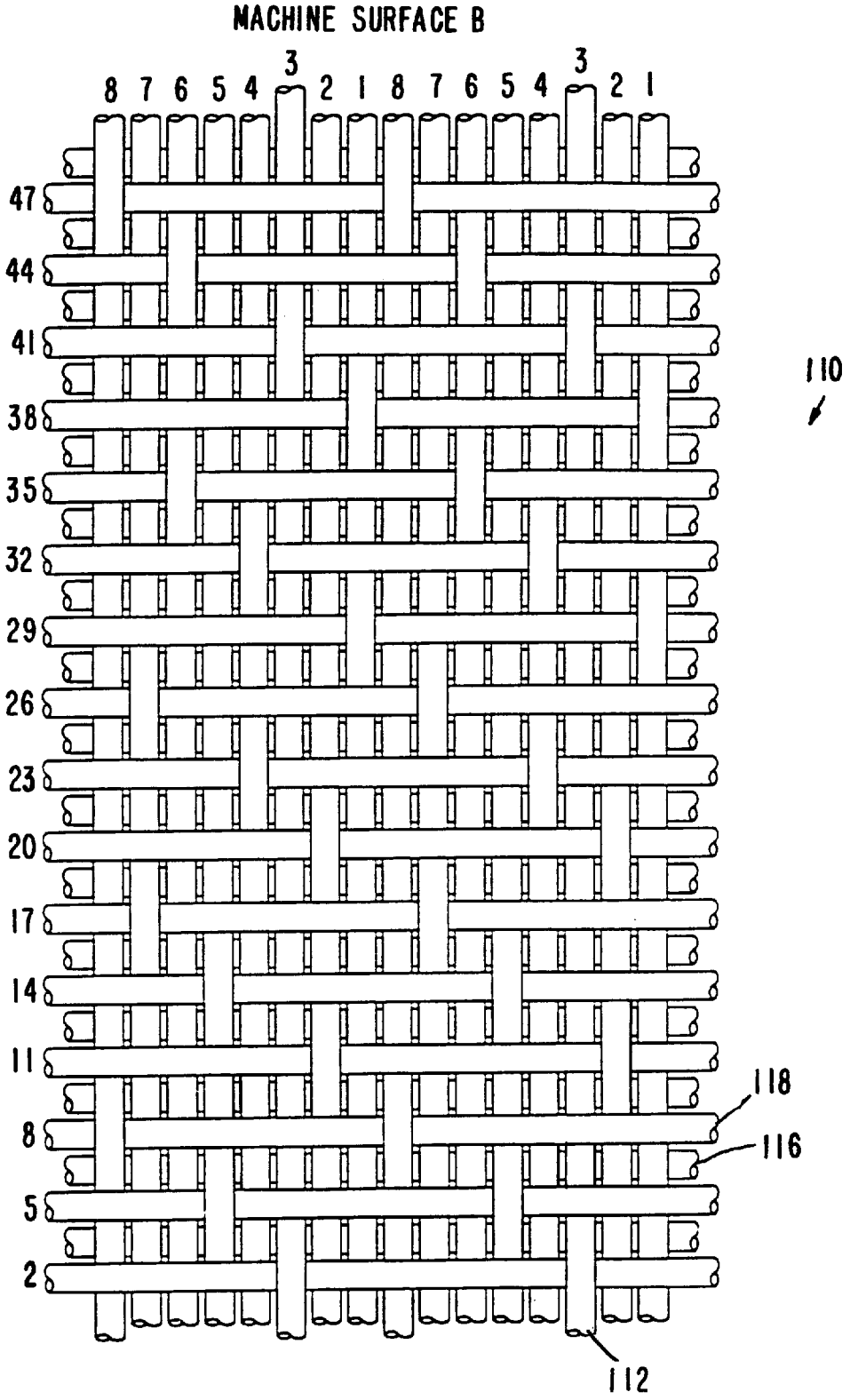
FIG. 2 is a sectional top view of the machine support surface of the papermaking fabric of the invention through two repeats of the weave pattern.

Turning now to the drawings; FIG. 1 shows a section of the paper support surface A of papermaking fabric 10 of the invention through a complete repeat of the weave pattern. As shown there are eight warp yarns 12, numbered 1–8, which are controlled by eight harness frames in the usual manner to weave with weft yarn 14 and 16 to form the upper paper support layer A. FIG. 2 shows the same warp yarns 12 weaving with lower weft yarns 18 to further contact layer B.

Figure 3:
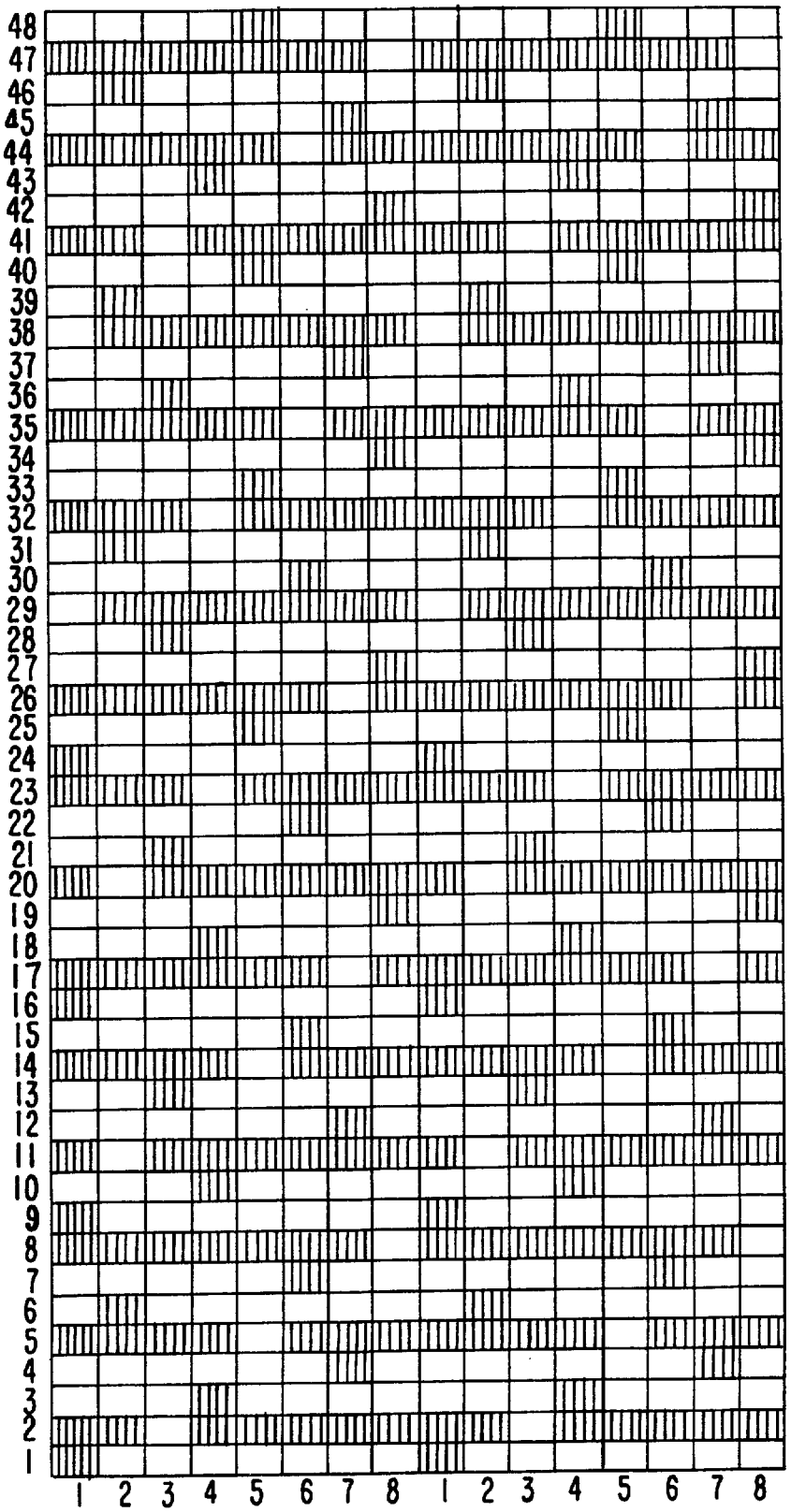
FIG. 3 is a weave diagram for the papermaking fabric of the invention through two repeats of the weave pattern.

The complete weave pattern, as shown in FIG. 3, comprises warp yarns 12 weaving with weft yarn 14, 16, and 18 to form a complete repeat of the weave pattern. Preferably the warp and weft yarns are formed of monofilament polyester yarns ranging in diameters of between 0.0032 to 0.0450 inches. Preferably, the warp yarn diameter is about 0.0050 inches and the diameter of weft yarns 14 and 16 are is about the same. Optionally, upper weft yarns 14 and 16 may be smaller or larger than the warp yarns by about 0.0020 inches while lower weft yarns 18 may be larger in diameter than the warp yarns by about 0.020 inches.

Other materials are acceptable for forming one or both the warp and weft yarns such as polyamide, plyetherketone or blends thereof. Also, multi-filament may be used.

Figure 6:
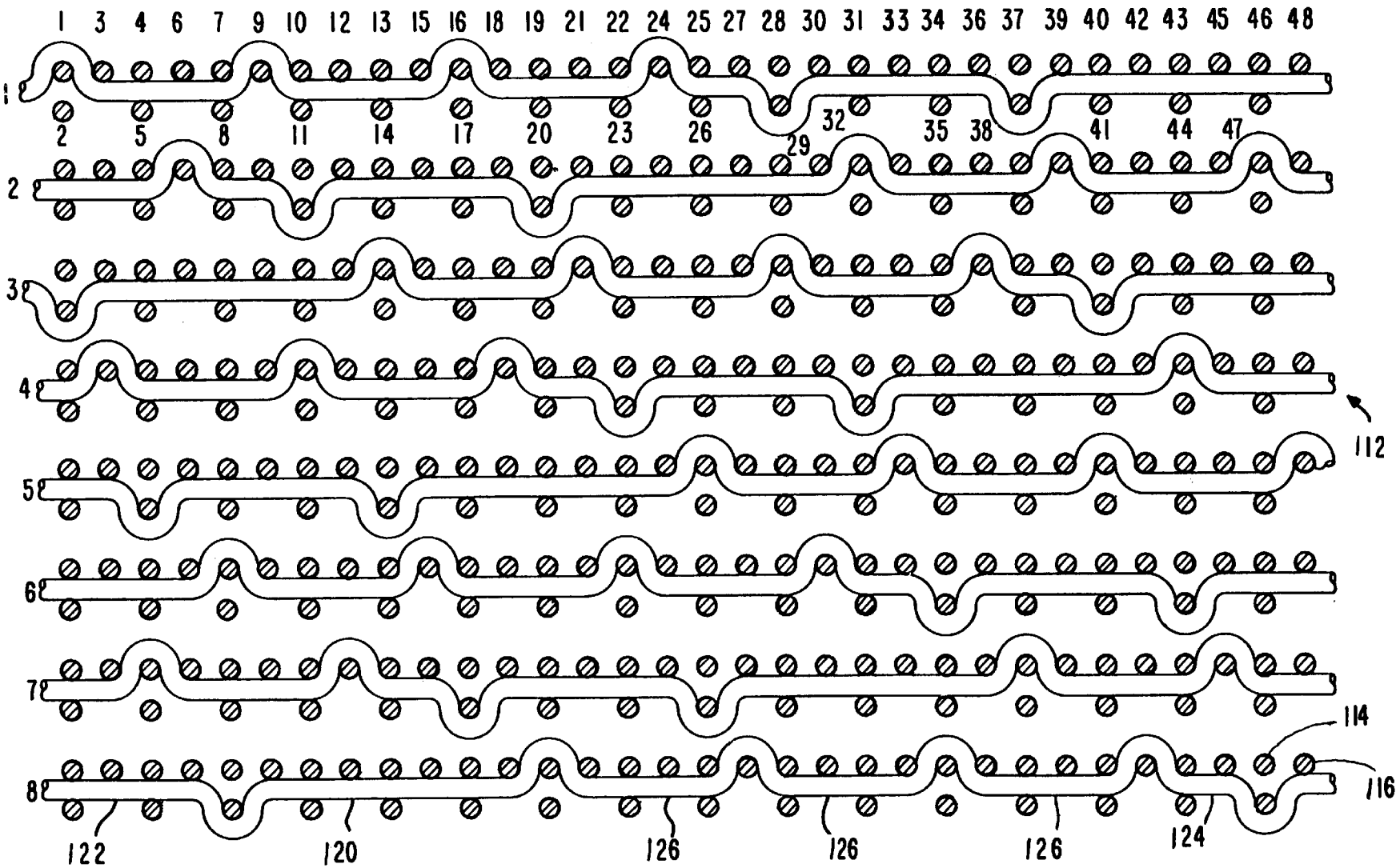
FIG. 6 is a side sectional view showing the relationship of each warp and weft yarn throughout a single repeat of the weave pattern.

Turning now to FIGS. 1, 2, and 6, it can be seen that warp yarns 12 are arranged as a single set which weaves with both the upper layer weft yarns 14, 16, to form the paper support surface A and the lower layer of weft yarns 18 to form the machine contact surface B. FIG. 6 clearly shows that each warp yarn 12 of the pattern repeat weaves over only four spaced picks 14, 16 on the paper support surface per repeat of the weave pattern. By way of example warp yarn 1 of warp yarns 12 weaves to cross-over only picks 1, 9, 16, and 24 of the weft yarns, while passing beneath the remaining upper layer weft yarns 14, 16. Warp yarn 1 also passes over all lower weft yarns 18 through the weave pattern, except where it weaves twice to pass beneath lower layer picks 29 and 38. Likewise warp yarn 2 of warp yarns 12 is controlled to pass over only upper layer picks 6, 31, 39, and 46 and to pass under lower layer picks 11 and 20 through a repeat of the weave pattern. Warp yarns 3–8 weave in similar manner as shown in the drawing.

Figure 4:
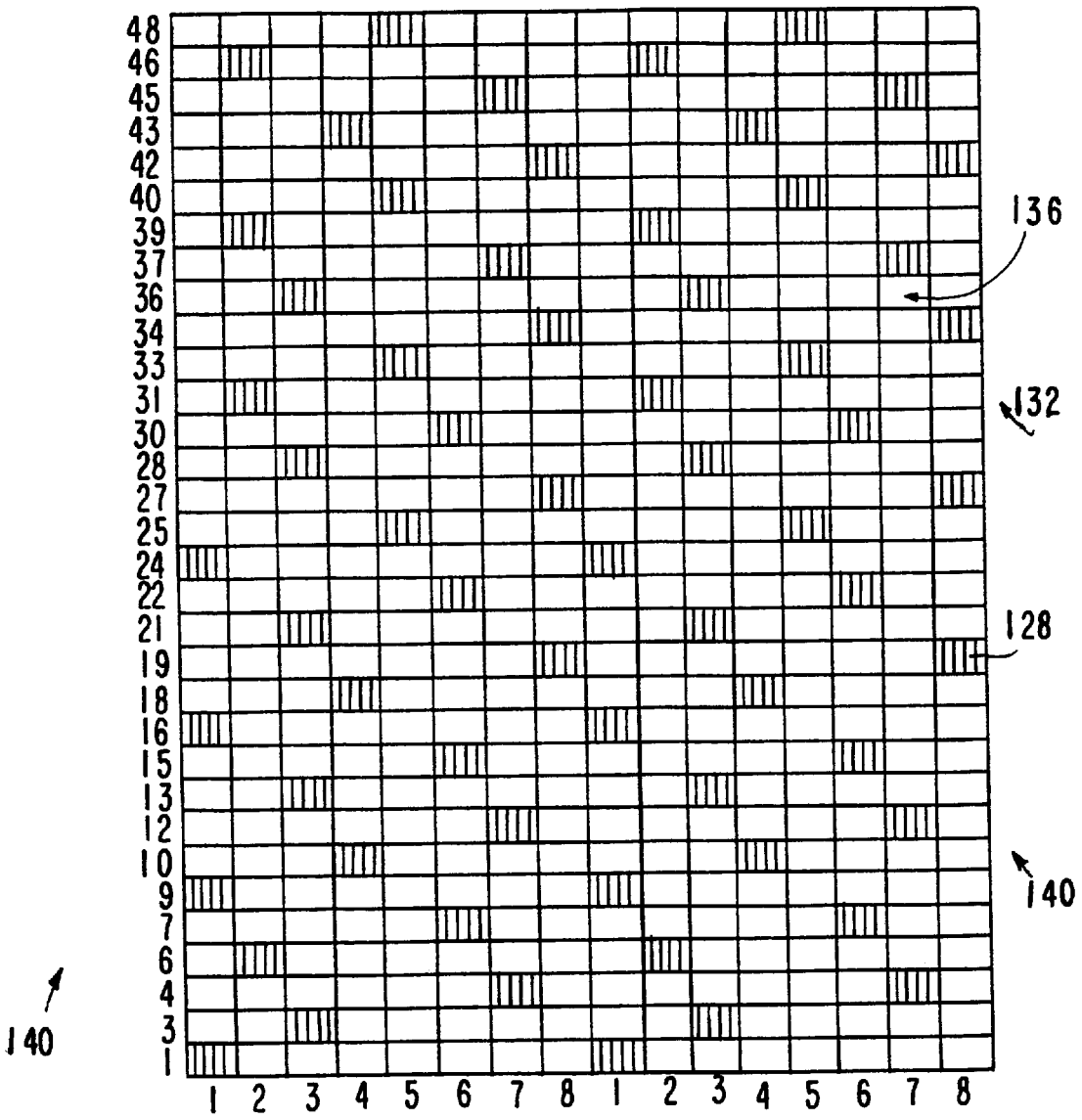
FIG. 4 is a weave diagram for the paper support surface only through two repeats of the weave pattern.
Figure 5:
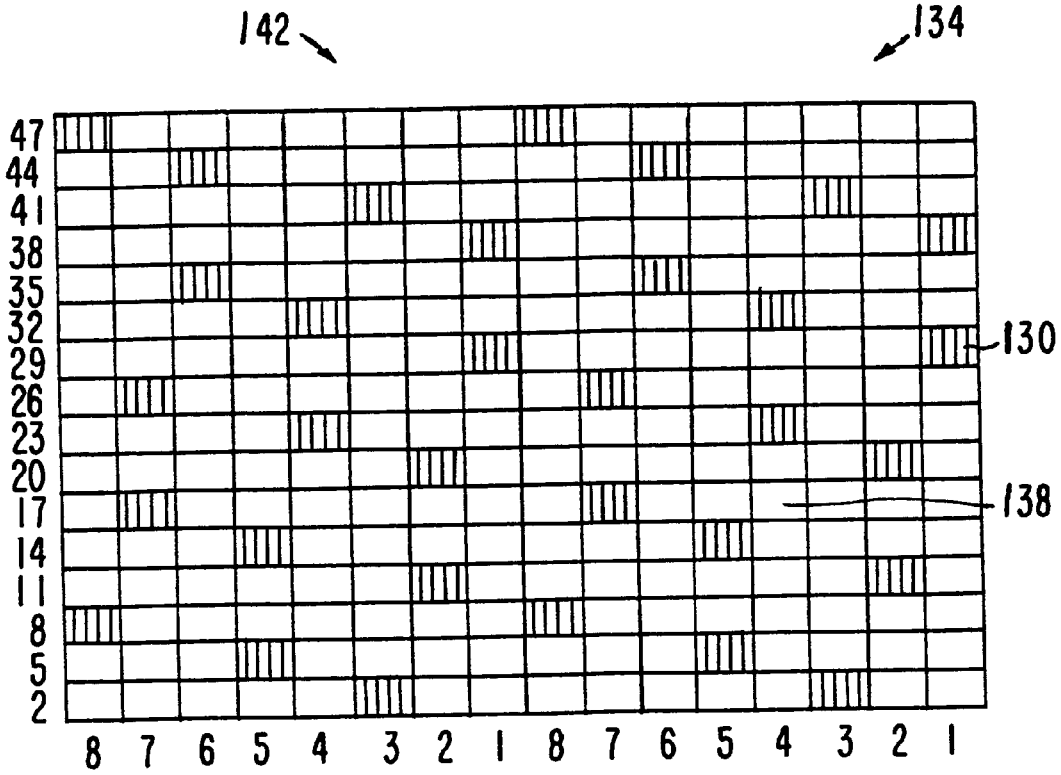
FIG. 5 is a weave diagram for the machine contact surface only through two repeats of the weave pattern.

The weave pattern provides a balanced construction in which the warp yarns form a plurality of inner floats 20, 22, 24, and 26 along each of warp yarns 1–8 of warp 12. As best seen in FIG. 6, these inner floats are relatively short, passing beneath seven and above three picks; beneath five and above two picks; beneath two and above one pick; beneath four and above two picks along each warp yarn of warp 12 through the weave pattern. As best seen in FIGS. 4 and 5 the warp cross-overs 28 and cross-unders 30 are evenly spaced over the weave pattern. The combination of relatively short inner floats uniformly dispersed and tied into the support and contact surfaces over the area of the weave pattern provides a balanced weave which equalizes the stress over the warp yarns.

This construction provides that inner floats 20, 24, and 26 along with each of the yarns of warp 12 remain in general parallel alignment during the life of the papermaking fabric. Because the yarns of warp 12 maintain their alignment, the drainage openings through the fabric are maintained uniform providing equal drainage over the entire support surface.

The weave pattern, as shown in FIGS. 1–6, provides an upper paper support surface A in which the warp cross-overs, indicated at 28, are arranged in diagonal rows 32 across support surface A. The weave also provides that each pick of weft yarns 14, 16 weaving with the upper layer forms weft floats 36 across the width of the weave pattern. These floats are of equal length and also form twill lines 40 across the fabric width.

By locating the warp cross-overs 28, which tie down opposed ends of the weft floats 36, in staggered positions located along opposite sides of intermediate sections of each weft float, the weft floats forming the support surface are stabilized to remain along their transverse axis and substantially parallel of each other. In addition to promoting even drainage the stabilized floats provide form a more even support surface which reduces marking of the paper product supported thereon.

The warp cross-unders 30 on the machine contact surface B are likewise positioned along diagonal rows 34 forming twill lines across the fabric. The weft floats 38, which are also of equal length across the width of the weave pattern for each pick, are arranged in diagonal rows forming twill lines 42. Each float is anchored at each end by a warp cross-under 30.

The papermaking fabric as described provides even drainage throughout and the paper support surface which is also even and smooth. The fabric exhibits good stability due to the balanced weave pattern which provides even distribution of the anchoring points, the points where the warp yarns pass over or under the weft yarns, over both the paper support and machine surfaces.

The fabric which is preferably a forming fabric has been described as being woven flat with the warp yarns extending in the machine direction (MD) and the weft yarns extending in the cross machine direction (CMD). It is within the scope of the invention to weave the fabric continuous in which case the weft yarns would extend in the MD and the warp yarns in the CMD.

While a preferred embodiment of the invention has been described using specific terms, such description is for illustrative purposes only, and it is to be understood that changes and variations may be made without departing from the spirit or scope of the following claims.

What is claimed is:

1. A wear resistant dual layer papermaking fabric having an upper paper fiber support surface and a lower machine contact surface, said fabric comprising:

a first plurality of picks of weft yarn weaving with a plurality of warp yarns in a twill weave to form, on said support surface, consecutive weft yarn floats of equal length passing over equal members of adjacent of said warp yarns forming said support surface as a weft dominated surface, said warp yarns cross over ends of said weft yarn floats anchoring said weft yarn floats;

a second plurality of picks of weft yarn weaving with said warp yarns in a twill weave to form on said machine surface consecutive weft yarn floats of equal length passing under even numbers of adjacent of said warp yarns forming said contact surface as a weft dominated surface; and, providing the number of said support surface weft yarn floats be at least twice the number of said machine surface weft yarn floats.

2. The fabric of claim 1 wherein said fabric is formed in a weave pattern having eight warp yarns per repeat.

3. The fabric of claim 2 wherein said weave pattern repeats every forty-eight picks of said weft yarn.

4. The fabric of claim 1 wherein each said weft yarn float is anchored by a single warp cross over per repeat of said weave pattern.

5. The fabric of claim 1 wherein cross-overs of said warp yarns are located on opposed sides of each of said support surface weft yarn floats intermediate of its length.

6. The fabric of claim 5 wherein said warp yarn cross-overs on opposed sides of each support surface weft yarn float are formed by adjacent of said warp yarns.

7. The fabric of claim 1 wherein said support surface and machine surface weft yarn floats are diagonally staggered across said fabric.

8. The fabric of claim 1 wherein said warp yarns are of equal size.

9. The fabric of claim 1 wherein said weft yarns are of a plurality of sizes.

10. The fabric of claim 1 wherein half of said first picks of weft yarn are located substantially vertically of said second picks of weft yarn and the remainder of said first picks of weft yarn are located between said half of first picks of weft yarn.

11. The fabric of claim 10 wherein said of said half of said first picks and said second picks weft yarns are substantially equal in size.

12. The fabric of claim 11 wherein said weft yarn of said remainder of said first picks differ in size relative to said weft yarn of said second picks.

13. A papermaking fabric comprising:

a lower CMD layer having a selected number of yarns per inch;

an upper CMD layer having a selected number of yarns per inch twice that of said lower CMD layer;

a system of MD yarns interwoven with said CMD yarn layers in a repeated weave pattern;

each said MD yarn interweaving to cross under an even number of lower CMD yarns and to cross over an even number of upper CMD yarns, the number of upper CMD yarn cross-overs being twice the number of lower CMD cross-unders per weave pattern repeat, said MD yarn cross-unders and cross-overs being arranged in twill arrays diagonally across said weave pattern; wherein, opposed surfaces of said fabric are comprised of a plurality of CMD floats arranged in a twill pattern between said spaced MD cross-unders and cross-overs.

14. The fabric of claim 13 wherein said fabric has a porosity of between 400 and 900 CFM.

15. The fabric of claim 13 wherein said weave pattern comprises eight warp yarns and forty-eight picks of weft yarns per repeat.

16. The fabric of claim 13 wherein each of said MD yarns form inner floats between said upper and lower CMD yarns, said cross-unders and cross-overs of adjacent MD yarns being intermediate ends of adjacent of said inner floats.

17. The fabric of claim 16 wherein said inner floats along each said MD yarn are of different lengths.

18. The fabric of claim 17 wherein there are four said different length inner floats formed along each said MD yarn.

19. The fabric of claim 13 wherein said each said MD yarn interweaves to cross over four of said upper layer CMD yarns per repeat of said weave pattern.

20. The fabric of claim 13 wherein said weave pattern provides that said upper layer CMD yarn floats have MD yarn cross-overs located along opposed sides and intermediate their length.

21. The fabric of claim 20 wherein said CMD floats are of equal length.

* * * * *